United States Patent [19]

Boël et al.

[11] 3,971,175

[45] July 27, 1976

[54] FACTORY-MADE HABITATION CELL

[75] Inventors: Charles Boël, Bully-Les-Mines; Jean-Pierre Cottin, Lens; François Guitard, Lille, all of France

[73] Assignee: Houilleres du Bassin du Nord et du Pas-de-Calis, France

[22] Filed: Oct. 28, 1975

[21] Appl. No.: 626,181

Related U.S. Application Data

[63] Continuation of Ser. No. 485,216, July 2, 1974, abandoned.

[30] Foreign Application Priority Data

July 3, 1973 France ..... 73.24465
June 13, 1974 France ..... 74.20608

[52] U.S. Cl. ..... 52/79; 52/126; 52/236

[51] Int. Cl.[2] ..... E04B 1/348

[58] Field of Search ..... 52/122, 126, 79, 236

[56] References Cited

UNITED STATES PATENTS

| | | | |
|---|---|---|---|
| 2,005,301 | 6/1935 | Rafter | 52/601 |
| 3,350,821 | 11/1967 | Tones | 52/126 |
| 3,378,971 | 4/1968 | Singer | 52/79 |
| 3,446,345 | 5/1969 | Frosoy | 248/345.1 |
| 3,550,334 | 12/1970 | VanDerlely | 52/79 |
| 3,716,954 | 2/1973 | Kelbish | 52/79 |
| 3,721,052 | 3/1973 | Boël | 52/79 |
| 3,742,660 | 7/1973 | Bierweiler | 52/79 |
| 3,834,095 | 9/1974 | Ohlson | 52/236 |

FOREIGN PATENTS OR APPLICATIONS

| | | | |
|---|---|---|---|
| 1,171,513 | 1/1959 | France | 52/601 |
| 1,482,637 | 5/1967 | France | 52/126 |
| 251,308 | 4/1926 | United Kingdom | 52/122 |
| 572,894 | 2/1958 | Italy | 52/79 |
| 145,324 | 5/1962 | U.S.S.R. | 52/122 |

*Primary Examiner*—Ernest R. Purser
*Assistant Examiner*—Henry Raduazo
*Attorney, Agent, or Firm*—Bucknam and Archer; Bucknam and Archer

[57] ABSTRACT

Habitation cells are prefabricated and comprise a floor with U-shaped irons at the corner. The cell in place on a floor rests on these irons.

6 Claims, 5 Drawing Figures

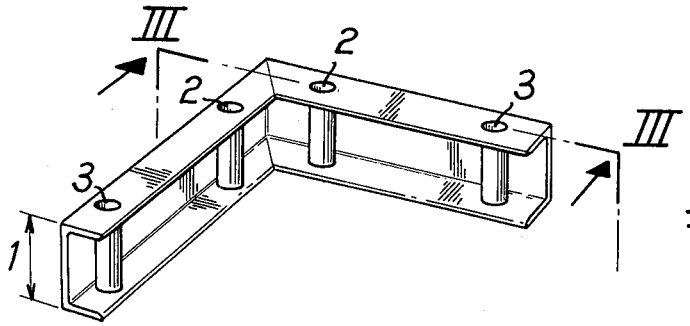
Fig. 1
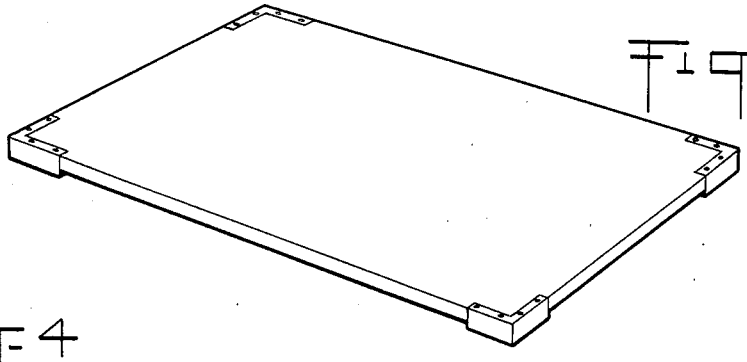
Fig. 2
Fig. 4
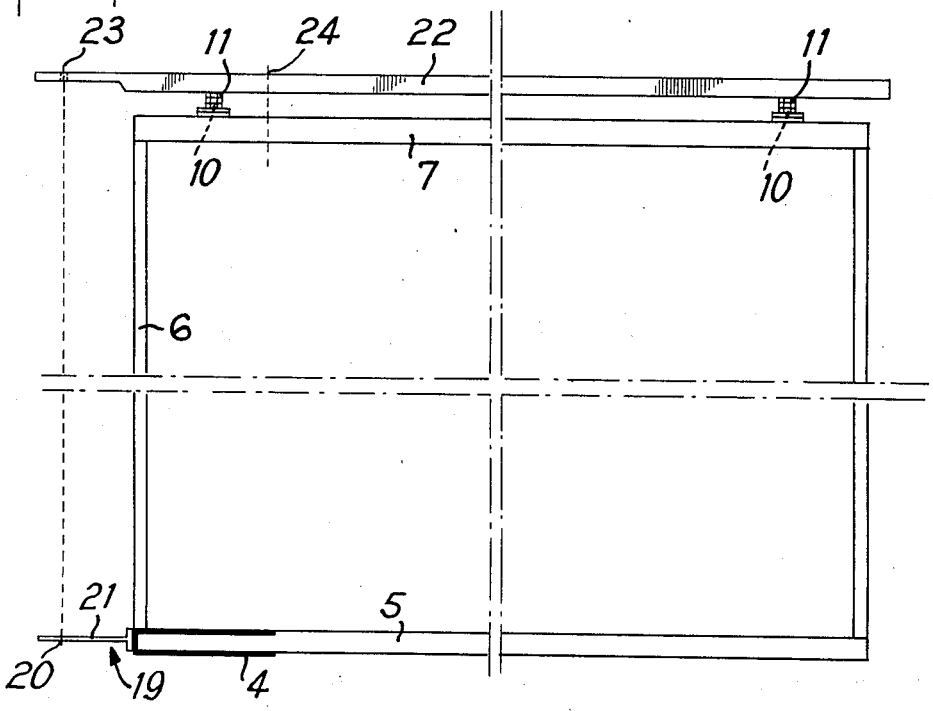

FACTORY-MADE HABITATION CELL

This is a continuation of application Ser. No. 485,216 filed July 2, 1974 and now abandoned.

This invention relates to a method of manipulating and putting in place preferably factory-manufactured habitation cells.

Habitation cells are known which are formed by thin reinforced concrete side walls bolted to one another and to reinforced concrete slabs forming the floors and ceilings of the cells. Cells of this kind are assembled at the factory and then transported to the building site, where they are put in place to form dwelling places of the various kinds.

Cells of the kind specified have thin side walls (3–8 cm) and relatively thin floors and ceilings. Nevertheless, the cells are heavy (of the order of 10–18 tons, for instance), so that considerable difficulties arise in gripping the cells and manipulating them and putting them precisely in place when constructing buildings of several storeys.

Moreover, the putting in place of prefabricated cells encounters certain difficulties mainly due to the tolerances which must be permitted in the reinforced concrete slabs forming the cells. For instance, there may be chance differences of several millimeters between the thickness of the slabs forming the floors of the cells; the same thing applies to the height of the side walls and also, of course, to the thicknesses of the ceiling slabs. These differences may be additive, thus making it very hard on the one hand to obtain a perfectly flat floor by the juxtaposition of cells at the same level, and on the other hand to superimpose the cells exactly one upon the other.

The invention, whose object is to solve these various difficulties, is mainly characterized in that the factory-assembled habitation cells comprise a floor slab which has at each corner U-irons whose total width is at least equal to the thickness of the floor slabs, the U-irons being so disposed that one of their arms is flush with the upper surface of the floor slabs, their base is flush with the side faces of the floor slabs, and their second arms are therefore disposed below the lower surface of the floor slabs.

According to another feature of the invention there is welded to the external face of the base of the U-iron a screwthreaded element adapted to receive the screwthreaded element of a metal bar via which, and the agency of a rocking bar, the cells can be manipulated by grasping them at the top.

According to one of the features of the invention, therefore, the corners of the floor slab have suitably positioned U-irons. The irons can be coupled to one another, but they are preferably assembled in pairs, after the fashion of an angle iron, in accordance with a template, so as to form a precise assembly. If necessary, portions of U-irons of identical dimensions can be disposed on certain parts of the side faces of the floor slabs.

When the habitation cell according to the invention is put in place, the cell will rest entirely via the lower face of the second face of the arm of the U-iron, either on a foundation prepared in advance (in the case of ground floor cells), or on a suitable device to be disclosed hereinafter (in the case of the cells of higher storeys).

The use of the U-irons of high mechanical strength completely eliminates chance differences in thicknesses in the concrete forming the floor slab, since the tolerances in the mechanical industries producing such irons are of course much smaller than those which can be obtained in the reinforced concrete industry.

Another advantage of using the irons is that the plane of the upper surface of the floor slabs of the cells is also clearly defined, so that a single plane can be more precisely defined for the whole of the cells at the same level.

As already stated, if the irons are assembled beforehand and disposed at the four corners of the slabs, four reference marks will be obtained forming a perfectly defined rectangle.

The reinforced concrete sheets forming the side walls of the cells will be bolted to one another and to the floor slab in known manner. The slab forming the ceiling of the cells will also be bolted to the side walls. However, the side walls and ceiling slab will also have tolerances which may be troublesome. It is therefore indispensable to try to recreate for the cells in the upper storey a plane of rest strictly parallel with the plane forming the upper surface of the floor slab.

To this end according to the invention, bolts of suitable size will be used which co-operate with nuts countersunk in the ceiling slabs of the cells. Since it would not be very reasonable to support the weight of the upper cells on the screwthreadings of such bolts and nut, wedges transferring the compressive force over a wide surface of the ceiling slab will be inserted between its upper face and the heads of the bolts. Moreover, when the upper cell is put in place, the outer part of the bolts will be enclosed in fresh mortar which, after hardening, will offer a wide supporting surface enabling the weight of the upper cell to be suitably distributed over the lower cell.

By a very simple adjustment, therefore, a plane parallel with the plane forming the cell floor and disposed at a predetermined distance therefrom can be defined above the ceiling slab of the cells. In practice use will be made of a simple strut defining the distance between the upper face of the bolts and the associated lower face of the second arm of the U-iron disposed in the floor of the same cell. The advantage of this embodiment is that the whole of the operation can be performed at the factory during the assembly of the cells. The bolts will have to be suitably positioned, since the contact between the upper surface of the bolts and the lower face of the U-irons of the upper cell must determine the position in height of the latter. Preferably, therefore, the bolts will be disposed adjacent the corners of the cells.

However, it is not enough for the upper cell to be suitably positioned in height in relation to the lower cell, the upper cell (i.e., the ceiling slab of the upper cell) must also be disposed exactly above the lower cell (i.e., the floor slab of the lower cell acting as a fixed reference place).

To this end the following method according to the invention will be used:

The floor slab of the upper cell will have on its lower face two pins (for instance, tubes) whose position is exactly defined in relation to the edges of such floor slab, and more precisely in relation to the U-irons carried thereby; the pins must be long enough to be inserted in holes in the upper face of the ceiling slab of the lower cell; the exact location of the holes is therefore determined in relation to the floor slab of the lower cell, and, when the latter is put in place, it will be enough to insert each of the pins in the corresponding hole in the lower cell.

The essential problem therefore is to determine the exact location of the holes to be made in the upper face of the ceiling slab of the lower cell. Clearly, the holes will not be made directly in the reinforced concrete of the slab, but in pieces of wood inserted in the concrete of such slab.

To determine this location, the U-irons carried by the floor slab of the lower cell will also be used, the operation being performed in the following manner:

Any piece bearing a reference mark is attached to the base of a U-iron borne by the floor slab (such base appearing on a side face of such slab); a bar is disposed on the upper surface of two adjusted bolts disposed on the ceiling slab of the cell (the bolts being of course those disclosed hereinbefore), the bar bearing a sighting device which enables the bar to be suitably positioned (by a horizontal traversing movement), so as to bring the sighting device on to a line perpendicular to the bar and extending through the reference mark on the piece connected to the U-iron of the floor slab. The bar position thus defined enables a point to be determined on the upper surface of the ceiling slab of the cell which is at a given distance from the base of the U-iron and therefore from the side face of the floor slab of the cell. The operation is repeated with another U-iron borne by the same side face of the floor slab, and a line parallel to such side face is determined. The same operations are repeated with two U-irons borne by the side face of the floor slab, perpendicular to the preceding side face, and another line parallel to such other side face is determined; the intersection of the two lines gives a point very well defined in relation to the floor slab at which the aforementioned hole will be drilled.

The U-irons inserted in the floor slab therefore give a reliable reference point for putting various other cells in place.

The same U-irons can also be used as supports and references for the putting in place of facade walls whose plane will be exactly perpendicular to the plane of the surface of the floor slab.

Clearly, the advantage of the method of putting in place according to the invention is that all the preparatory operations can be performed at the factory where the cells are assembled. On the building site all that the operator has to do is to make sure that the pins borne by the floor slab of the upper cell are inserted in the holes in the upper face of the ceiling slab of the lower cell. Moreover, the tolerances inevitable in reinforced concrete walls are considerably reduced, and therefore the relative positions of the individual cells will be determined in advance with very great precision, thus reducing the associated cost of finishing.

Moreover, as already stated, the handling of the cells at the factory after assembly, during their transportation and while they are put in place on the building site can be assisted by welding a screwthreaded metal element to the U-irons at the corners of the floor slabs of the cells. The handling is characterized in that use is made of a rocking lever which is disposed above each cell and exactly positioned, so that the metal rods connecting slides unitary with the rocking bar to the screwthreaded metal elements welded to the U-irons are parallel with the ridges of the cells.

The invention will be more clearly understood from the following non-limitative embodiment illustrated in the drawings wherein:

FIG. 1 is a perspective view of a U-iron which can be used according to the invention to form a corner of the floor slab;

FIG. 2 is a perspective view of a floor slab having a U-iron as illustrated in FIG. 1 at its four corners;

FIGS. 3 and 4 illustrate diagrammatically, in partial section and elevation, the putting in place of the cells.

FIG. 1 is a perspective view of a U-iron which can be used for forming a corner of the floor slab; the U-iron is formed by welding together two U-irons whose base 1 has a width of 12 cm (and is therefore greater than the thickness of the concrete slab). This member has on each side two tubes 2, 3 which can be used on the one hand as holes for bolting the side walls on to the floor slab, and also for receiving a pin which positions the upper cell in relation to the lower cell; the holes are also used for checking the exact dimensions of the member and making sure that they are up to the standards required. The base of the member can be formed with one or more holes for receiving devices for attaching facade walls where this is necessary.

FIG. 2 shows in perspective a floor slab having at its four corners a member such as that illustrated in FIG. 1. FIG. 2 shows how one of the arms of the U-irons is flush with the upper plane of the concrete slab, the bases of the U-irons are flush with the side faces of the slab, and the other arms of the U-irons clearly extend beyond the lower face of the slab.

Figure 3:
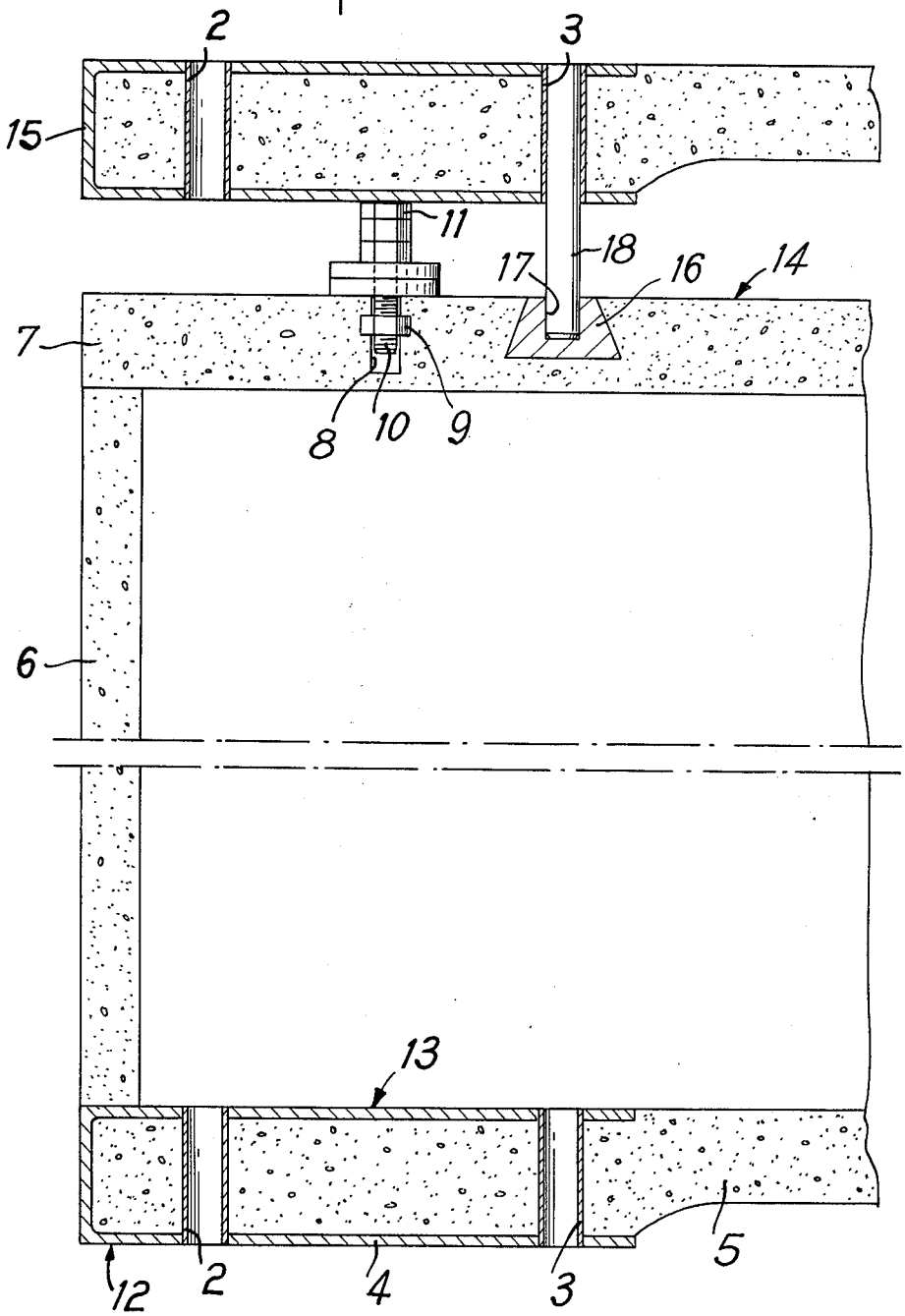

FIGS. 3 and 4 illustrate diagrammatically, in partial section and elevation, how the cells can be put in place one above the other according to the invention. The section is taken along the line III — III in FIG. 1, the side wall not being shown.

FIG. 3 shows a portion 4 of the U-iron comprising the two tubes 2, 3, a concrete slab 5 forming the floor of the lower cell, a concrete slab 6 forming one of the side walls of the cell, and a concrete slab 7 forming the ceiling of the cell, the slabs 5 and 6 being connected to one another by bolting, as also are the slabs 6 and 7, a hole 8 made in the slab 7 from its upper surface and receiving a nut 9 into a bolt 10 having a head 11 is inserted. By inserting the bolt 10 in the nut 9 it is easy, for instance using a measuring apparatus, to ensure that the upper surface of the head 11 of the bolt is disposed at a predetermined distance from the lower face 12 of the U-iron 4. A repetition of this operation at at least three points of the lower cell (at its four corners, for instance) ensures that the upper faces of the heads 11 are disposed in a plane exactly parallel to the plane defined by the lower faces of the U-irons borne by the floor slab and therefore parallel to the plane of the upper surface 13 of the floor slab.

The adjustment of the bolts 10 is performed at the factory. Between the head 11 of the bolt and the upper surface 14 of the slab 7, various lock nuts and wedges of appropriate sizes are interposed so as to lock the bolt 10 in its final position and distribute the force exerted on the head of the bolt over an adequate surface of the upper face of the slab 7.

As already explained, the position of the bolts 10 is so selected that the heads 11 of the bolts rest on the lower face of a U-iron borne by the floor slab of the upper cell; only a portion of the floor of the upper cell with its U-iron 15 is shown.

At a place 16, a piece of wood has been inserted in the ceiling slab 7; the suitably positioned piece of wood is formed with an exactly positioned hole 17 in which a pin 18 is inserted protruding from one of the tubes borne by a U-iron 15 of the floor slab of the upper cell.

The problem of correctly putting in place the upper cell in relation to the lower cell therefore amounts to determining the exact position of the hole 17 in the piece of wood 16. The principle of how this determination is performed is illustrated in FIG. 4 which merely shows diagrammatically the U-iron of the floor slab of the lower cell, and two bolts 10 with their heads 11.

A member 19 having a reference mark 20 is placed or fixed on the outer face of the base of the U-iron; the member 19 is such that its portion 21 is perpendicular to the external face of the base of the U-iron.

Disposed on the upper face of the heads 11 is a bar 22 comprising a sighting device 23. The sighting device is used to move the bar 22 into a position such that the sighting device is exactly on the perpendicular to 21 above the reference mark 20. In that position the bar enables, for instance by means of one reference mark 24, to determine at least one point whose position is suitably defined in relation to the floor slab. The hole 17 can be exactly positioned in the piece of wood 16 by the intersection of two straight lines, by repeating the operation with two U-irons borne by adjacent faces of the floor slab (FIG. 3).

Generally the pieces of wood 16 are disposed adjacent the two opposite corners of the ceiling slab.

Figure 5:
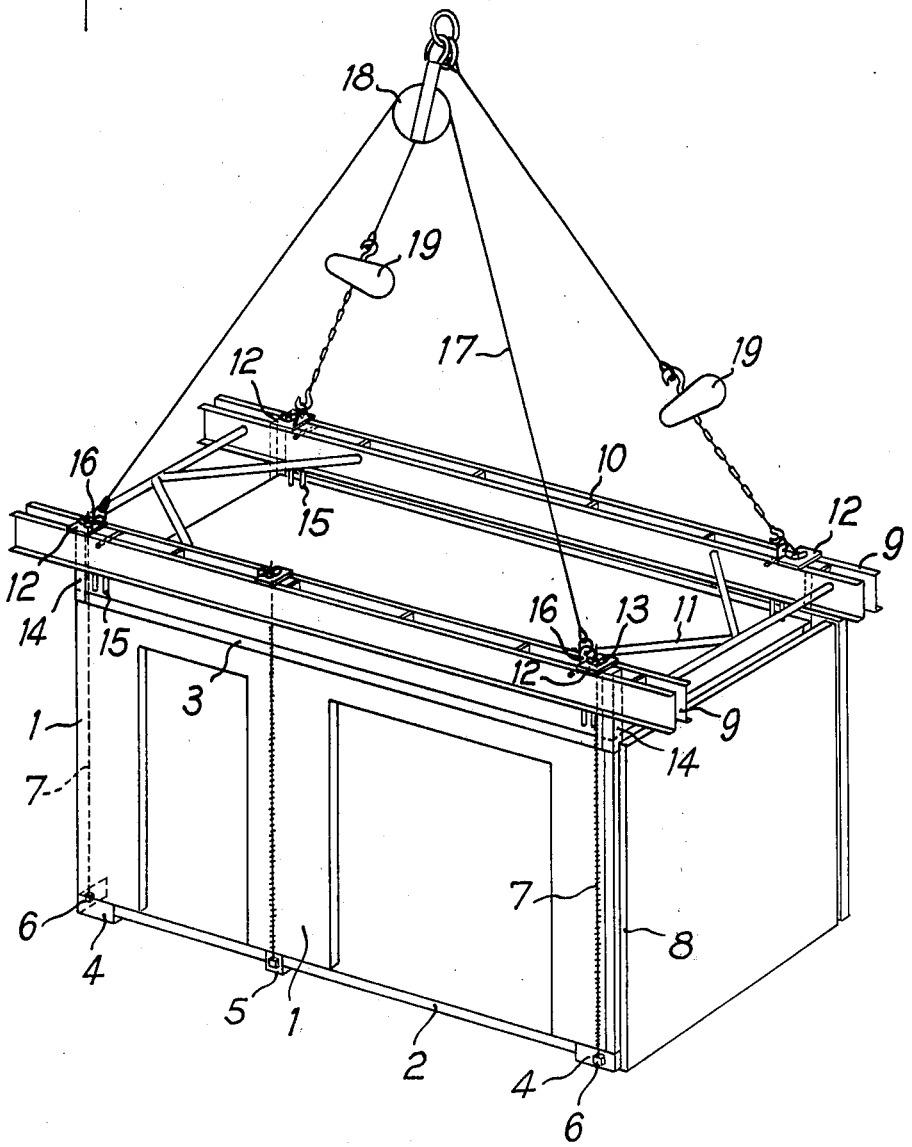
FIG. 5 illustrates the method of handling the cells by the use of a rocker bar enabling them to be gripped at the top.

FIG. 5 illustrates an embodiment of the method of gripping the cells at the top by means of a rocking bar co-operating with screwthreaded elements welded to the U-irons.

FIG. 5 shows two thin reinforced concrete slabs 1 (about 6 cm in thickness) forming the side walls of a cell; the slabs are bolted to one another and to reinforced concrete slabs forming the floor 2 and the ceiling 3 of the cell; U-irons 4 forming the corners of the floor slab (clearly, these irons are wider than the thickness of the floor and so disposed that the cell rests on the lower face of the irons when it is put in position); another U-iron 5 (similar to the irons 4) disposed towards the centre of the cell (this U-iron, which is not indispensable in general, may be useful for handling and the dimensional stability of certain cells having, for instance, door shaped apertures on one of their side faces; obviously, the U-iron 5 is disposed like the U-irons 4 in relation to the floor slab); and screwthreaded elements 6 simply formed by a metallic member welded to the U-irons and formed with a screw-threaded aperture into which metal rods 7 can be screwed. FIG. 5 shows a cell having an outer sheet 8 which can be used, for instance, to produce the facade of the house. Clearly, an insulating material can be disposed between the outer sheet and the corresponding side wall of the cell. The sheet 8 is connected to the cell via a metal member (not shown) which can be welded to the U-irons 4. Remembering that a wall of this kind may exist, and also that when the cells are disposed one beside the other to produce houses, the cells must not be too far away from one another, it is desirable for the dimensions of the elements 6 to be fairly small — i.e., the rods 7 must not be of excessive diameter. Use will be made, for instance, of a steel rod 7 having a diameter of 8 mm.

Since the cells will be gripped and handled using the rods, and the weight of the cells is of the order of 13 tons, to prevent any breakage of the rods they must operate mainly under tensile conditions, without considerable lateral stresses which might break the rods. This is the reason why the invention provides a gripping device specifically adapted for this purpose.

FIG. 5 shows that the device is formed by a rocking bar having the following main features, namely two pairs of beams 9 interconnected by struts, as 10, 11 and lockable slides 12. The slides 12 are so positioned that when the rod 7 has been put in place on the member 6 and extends through the opening (as 13) of a slide, the rod is parallel with the vertical ridge of the cell. In this position of the slide, the angle stop 14 thereof bears against the corners of the ceiling slab of the cell; the latter is therefore satisfactorily retained in an "ideal" position and the rod 7 cannot be subjected to the lateral stresses liable to break them. This positioning of the rocking bar in relation to the cell is further improved by the use if necessary of feet 15, which, when the rocking bar is put in place, bear against the upper face of the ceiling slab of the cell.

The resulting gripping device of the assembly formed by the cell and the rocking bar is therefore produced by known means. However, to prevent the cell from becoming deformed during its handling, the rocking bar can be made isostatic as follows: two gripping hooks 16 disposed on two slides borne by the same pair of beams are interconnected by a cable 17 running over a free pulley 18; the hooks disposed on the slides borne by the other pair of beams are each connected to a ring via a cable bearing an electric tackle 19 enabling the length of each cable to be adjusted.

What we claim is:

1. In a multi-story building structure having superposed modular cells, each cell having a floor slab, walls supported on said floor slab and a ceiling slab supported on said walls, the floor slab of one cell being spaced from and aligned with the ceiling slab of an underlying cell, the improvement which comprises in combination a floor slab of reinforced concrete and generally rectangular, a plurality of metal L-shaped corner pieces each bonded to said floor slab at a corresponding corner thereof, each corner piece having a pair of legs in the form of channels with generally U-shaped transverse cross sections, respective edge portions of the floor slab being received inside the channel openings of said legs, each leg having an upper outside surface and a lower outside surface, at least one tubular member connected to each corner piece and extending through the floor slab and a leg of the corner piece, a ceiling slab of reinforced concrete, spacer means received in said ceiling slab and disposed for engagement with a lower outside surface on a corner piece leg of the floor slab of an overlying cell to establish a given spacing between said ceiling slab and such floor slab, and alignment means received in said ceiling slab and received inside a tubular member associated with the floor slab of said overlying cell to establish a given alignment between such floor slab and said ceiling slab.

2. The improvement according to claim 1 wherein the upper outside surface of each corner piece leg is generally flush with the adjoining upper surface of the floor slab.

3. The improvement according to claim 1 wherein the lower outside surface of each corner piece leg is disposed below the adjoining lower surface of the floor slab.

4. The improvement according to claim 1 wherein said alignment means includes a socket embedded in said ceiling slab and a pin received in said socket and extending into said tubular member.

5. The improvement according to claim 1 wherein said spacer means includes a socket embedded in said ceiling slab, and a post received by said socket and adjustably extending therefrom to engage said lower outside surface.

6. The improvement according to claim 5 wherein said post and socket are in threaded engagement, and including at least one spacer installed on said post to distribute on the ceiling slab load forces applied by said floor slab of the overlying cell.

* * * * *

UNITED STATES PATENT OFFICE
CERTIFICATE OF CORRECTION

Patent No. 3,971,175 Dated July 27, 1976

Inventor(s) Charles Boel, Jean-Pierre Cottin and Francois Guitard

It is certified that error appears in the above-identified patent and that said Letters Patent are hereby corrected as shown below:

Item (21) on the title page now reading 626,181 should be 626,081

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*